US008215824B2

(12) United States Patent
Lais

(10) Patent No.: US 8,215,824 B2
(45) Date of Patent: Jul. 10, 2012

(54) HOMOGENIZER DEVICE HAVING HORIZONTALLY MOUNTED GEAR RIMS

(75) Inventor: Sascha Lais, Loerrach-Haagen (DE)

(73) Assignee: FrymaKoruma AG, Rheinfelden (CH)

( * ) Notice: Subject to any disclaimer, the term of this patent is extended or adjusted under 35 U.S.C. 154(b) by 736 days.

(21) Appl. No.: 12/227,910

(22) PCT Filed: Jun. 2, 2007

(86) PCT No.: PCT/DE2007/001008
§ 371 (c)(1),
(2), (4) Date: Dec. 26, 2008

(87) PCT Pub. No.: WO2007/140764
PCT Pub. Date: Dec. 13, 2007

(65) Prior Publication Data

US 2009/0175122 A1 Jul. 9, 2009

(30) Foreign Application Priority Data

Jun. 3, 2006 (DE) ..... 20 2006 008 820 U

(51) Int. Cl.
*B01F 15/02* (2006.01)
*B01F 7/00* (2006.01)

(52) U.S. Cl. ..... 366/137; 366/257; 366/293; 366/296

(58) Field of Classification Search ..... 366/279, 366/131, 136, 134, 301, 304, 137, 257, 293, 366/296
See application file for complete search history.

(56) References Cited

U.S. PATENT DOCUMENTS

| | | | | | |
|---|---|---|---|---|---|
| 1,489,786 | A | * | 4/1924 | Povey et al. | 241/251 |
| 2,260,834 | A | * | 10/1941 | Everett | 366/131 |
| 2,441,711 | A | * | 5/1948 | McFadden | 366/296 |
| 2,477,929 | A | * | 8/1949 | Hetherington et al. | 366/131 |
| 3,779,531 | A | * | 12/1973 | White | 261/87 |
| 4,118,800 | A | * | 10/1978 | Reinhall | 366/341 |
| 4,239,470 | A | * | 12/1980 | Sherman | 418/153 |
| 4,514,090 | A | * | 4/1985 | Neubauer et al. | 366/91 |

(Continued)

FOREIGN PATENT DOCUMENTS

DE 19 13 940 6/1970

(Continued)

OTHER PUBLICATIONS

International Search Report, Dec. 8, 2008.

*Primary Examiner* — Joseph Del Sole
*Assistant Examiner* — Nahida Sultana
(74) *Attorney, Agent, or Firm* — Collard & Roe, P.C.

(57) ABSTRACT

In the case of a homogenizer device for dispersing and/or homogenizing substances capable of flow, having a container having one or more inlet openings for introducing the substances to be homogenized, which container has a container outlet opening for feeding the substances into a processing unit disposed below the bottom, in a central region of its bottom, which unit contains two gear rims, which are mounted to rotate independent of one another, are disposed concentrically and configured in circular shape, and are separated from one another by way of a predetermined interstice, effective homogenization, which can be adapted to a predetermined substance mixture, is achieved in that the drive shafts of a first gear rim and of a second gear rim of the processing unit are disposed perpendicular to the transport direction of the substances that leave the outlet opening, in each instance.

17 Claims, 8 Drawing Sheets

U.S. PATENT DOCUMENTS

Figure 1:
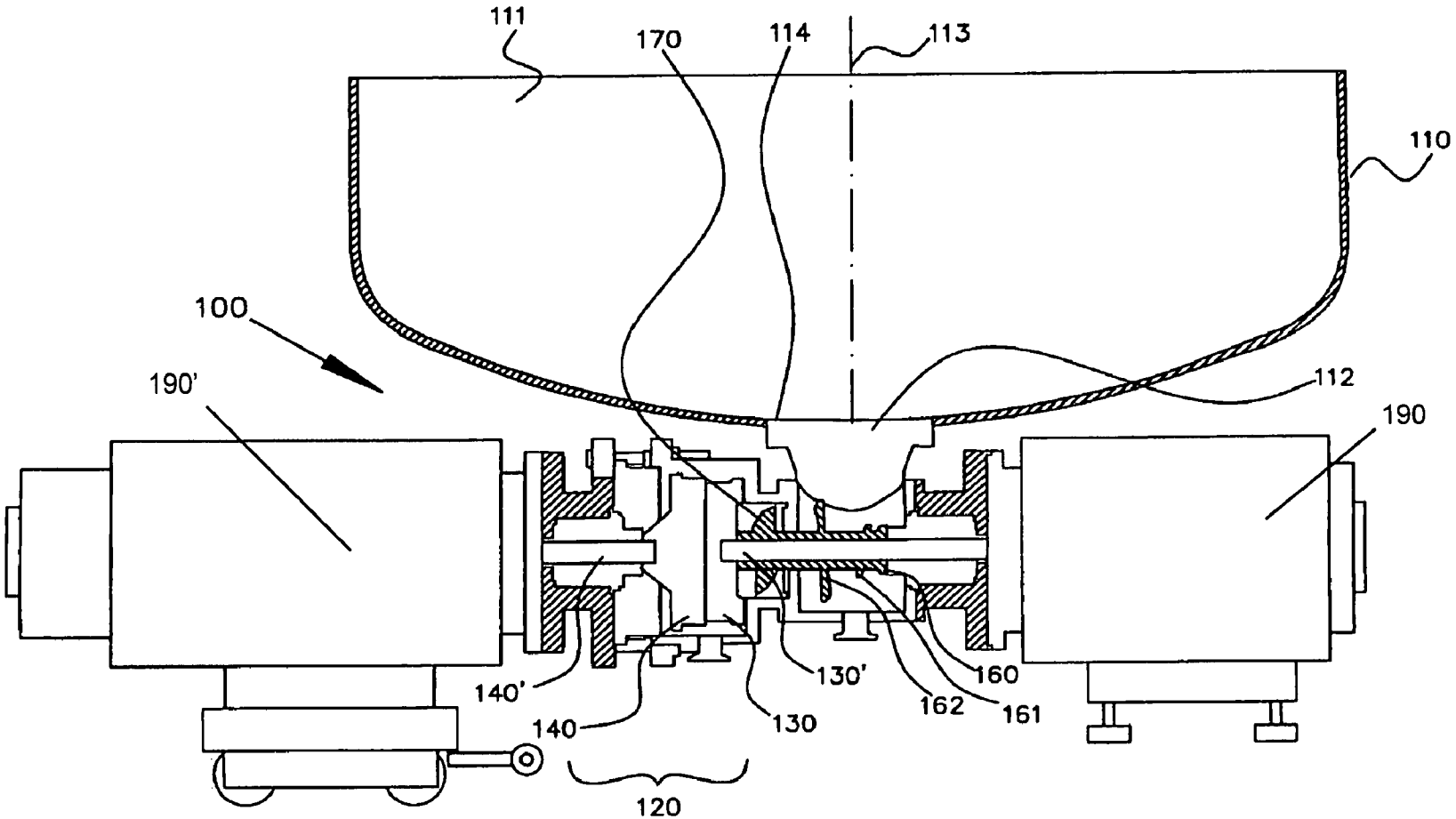

| | | | | |
|---|---|---|---|---|
| 4,584,934 | A * | 4/1986 | De Fockert | 99/462 |
| 5,607,233 | A * | 3/1997 | Yant et al. | 366/102 |
| 7,036,976 | B1 * | 5/2006 | Andersson | 366/294 |
| 7,191,700 | B2 * | 3/2007 | Sasaki | 100/117 |
| 2001/0037866 | A1 | 11/2001 | Kriebel et al. | |
| 2002/0075754 | A1 * | 6/2002 | Huber et al. | 366/152.1 |
| 2003/0072212 | A1 * | 4/2003 | Wood et al. | 366/170.3 |
| 2006/0233042 | A1 | 10/2006 | Buchholz et al. | |
| 2011/0197972 | A1 * | 8/2011 | Jones et al. | 137/3 |

FOREIGN PATENT DOCUMENTS

| | | | |
|---|---|---|---|
| DE | 2740075 | A * | 3/1978 |
| EP | 0 079 300 | | 5/1983 |
| EP | 0 291 820 | | 11/1988 |
| EP | 1 147 805 | | 10/2001 |
| EP | 1 712 271 | | 10/2006 |
| FR | 2 364 289 | | 4/1978 |

* cited by examiner

HOMOGENIZER DEVICE HAVING HORIZONTALLY MOUNTED GEAR RIMS

CROSS REFERENCE TO RELATED APPLICATIONS

This application is the National Stage of PCT/DE2007/001008 filed on Jun. 2, 2007, which claims priority under 35 U.S.C. §119 of German Application No. 20 2006 008 820.2 filed on Jun. 3, 2006. The international application under PCT article 21(2) was not published in English.

The invention relates to a homogenizer device for dispersing and/or homogenizing liquid to viscous substances, having a container having one or more openings for introducing the substances to be processed, which container has a container outlet opening for feeding the substances into a processing unit disposed below the bottom, in a central region of its bottom, which unit contains two gear rims, which are mounted to rotate independent of one another, are disposed concentrically and configured in circular shape, and are separated from one another by way of a predetermined interstice.

Devices of the type stated initially are used in the state of the art to homogenize viscous substances, at a high speed of rotation of the gear rims in question. However, the known devices have the disadvantage that effectively functioning and adaptable processing units that allow processing adapted to a predetermined substance mixture are large in dimensions, heavy in their structure, and expensive to produce.

It is therefore the task of the invention to create a homogenizer device having a compact processing unit, which functions effectively and nevertheless allows processing that can be adapted to a predetermined substance mixture.

For a device of the type stated initially, this task is accomplished in that the drive shafts of a first gear rim and of a second gear rim of the processing unit are disposed perpendicular to the transport direction of the substances that leave the outlet opening, in each instance.

Preferred embodiments of the invention are the object of the dependent claims.

In the case of the device according to the invention, the result achieved by the combination of characteristics, that the drive shafts of a first gear rim and of a second gear rim of the processing unit are disposed perpendicular to the transport direction of the substances that leave the outlet opening, in each instance, is that all the components of the processing unit can be affixed very close below the bottom of the container, and thus the substances to be homogenized can be introduced into the processing unit by way of a feed line that is shorter, in comparison with the state of the art, and also can be conveyed back into the container by way of a return line that is shorter, in comparison with the state of the art. In this way, processing of very small substance amounts is particularly made possible.

The method of construction according to the invention allows a drive motor to be directly flanged onto a drive shaft, avoiding gear mechanisms, belts, or the like. This has the consequence, for one thing, of a reduction in components, production costs, and maintenance costs. Furthermore, as a result of the direct coupling of the drive motor with the drive shaft, the formation of undesirable vibrations is reduced, and thus quiet operation and synchronization of shafts and rotors are increased.

It should be mentioned as another important advantage that when using normal, solidly structured drive shafts, it is possible to do without coaxial slide bearings, which are technically complicated, subject to wear, and therefore expensive, such as those used in designs having a central shaft/hollow shaft, since normal slide ring bearings replace them. In this connection, it is advantageous that normal slide ring bearings are subject to less stress than coaxial slide ring bearings, since the latter are exposed to twice as high a speed of rotation as the former, which implies greater friction, higher heat development, and thus greater wear. The above explanations apply analogously for the bearings of central shafts/hollow shafts in comparison with normal, solidly structured drive shafts.

The low construction height in comparison with a conventional device, in which the drive shafts of a first gear rim and of a second gear rim of the processing unit are disposed axially in the transport direction of the substances that leave the outlet opening, should be mentioned as another advantage of the device according to the invention.

According to a common preferred embodiment of the device according to the invention, it is provided that a mixing/transporting vane having a plurality of blade elements, for mixing the substances to be homogenized with at least one powdered substance, and for deflecting the transport path of the substance mixture by 90° in the direction towards the processing unit, which is disposed de-centered relative to the perpendicular container axis, is provided below the outlet opening, whereby the axis of rotation of the mixing/transporting vane is also disposed perpendicular to the transport direction of the substances leaving the outlet opening.

In the case of the device according to the invention in this common embodiment, liquid is divided into discrete liquid thrombi by means of the mixing/transporting vane, after it exits from the outlet opening of the container, which thrombi successively move in the direction towards the homogenization unit, behind the mixing/transporting vane, one behind the other.

In the region of the mixing/transporting vane, powder and possibly another liquid or powdered substance are fed into the liquid. In this connection, the powder and the optional additional substance mix more intensively with the liquid particles of a thrombus in a peripheral part of the thrombus than in a central region of the liquid thrombus, since the liquid particles have a greater movement energy in the peripheral region.

Furthermore, the liquid thrombus contains more liquid mass in its peripheral region than in its central region, so that clumping of the powder fed in can easily occur in its central region, since here, only few liquid particles are present, for one thing, and for another, the movement energy of these liquid particles is so slight that sometimes it is not sufficient to dissolve clusters of powder.

In the case of conventional homogenization devices, the powder clusters that have formed in a central region of a liquid thrombus in this manner can lead to plugging up in the region of the rotors in question, in a subsequent work step in a homogenization unit. These disadvantages are avoided by means of the device according to the invention.

The characteristics that a mixing/transporting vane having a plurality of blade elements, for mixing the substances to be homogenized with at least one powdered substance, and for deflecting the transport path of the substance mixture by 90° in the direction towards the processing unit, which is disposed de-centered relative to the perpendicular container axis, is provided below the outlet opening, whereby the axis of rotation of the mixing/transporting vane is also disposed perpendicular to the transport direction of the substances leaving the outlet opening, bring about the effect, in this connection, that more powder per time unit as compared with known devices can be introduced into a liquid substance mixture. The same effect exists also if in place of the liquid substances, viscous substances are used. This is also due to the fact that thrombus formation is avoided, to the greatest possible extent.

The thrombi that are formed in the case of vertical shaft mounting of the mixing/transporting vane would bring about a pressure in the direction of the inside wall of the feed line because of the velocity distribution of the particles of the peripheral region, due to centrifugal force, i.e. a pressure counter to the transport direction of the powder substances being fed in through the inlet taps. The feed of powder would be hindered by this. In the case of mounting of the mixing/transport vane according to the invention, this disadvantage does not occur, since thrombus formation is avoided, because the feed of powder substances is not impaired by an internal velocity and morphology profile of a thrombus. Instead, improved mixing of the substances in question occurs, to the greatest possible extent without the formation of thrombi.

The gear rims are preferably configured as part of a processing unit having a compact structure, which is disposed directly below the bottom of the container. In this connection, the gear rims, which are disposed perpendicular to the central axis of the container, are particularly driven by a shaft disposed horizontally in the processing unit, in each instance.

According to another preferred embodiment of the device according to the invention, it is provided that the second gear rim is mounted to be displaceable in the direction of its central axis, in such a manner that it can be switched from a first position, in which it is disposed radially behind the first gear rim, into a second position, in which it is disposed outside of the transport path of the substance capable of flow that is being transported by the first gear rim.

According to another preferred embodiment of the device according to the invention, it is provided that the substances, after processing by the gear rims, can be returned into the container into a container inlet opening in the region of the container bottom. In this connection, the container inlet opening is preferably provided in a central region of the container bottom. Alternatively, it can be possible to return the substances into the container, after processing by the gear rims, also into a container inlet opening in the region of the container wall.

In the device according to the invention, the substances are preferably passed from a central region to a peripheral region of the gear rims, through the intermediate space.

According to an important preferred embodiment of the device according to the invention, it is provided that the distance between the gear rims is adjustable by way of at least one shaft mounted in displaceable manner. In this connection, the shafts of the gear rims can preferably be driven by separate drive units, and in this connection can preferably be operated in the same direction or in opposite directions.

According to another important preferred embodiment of the device according to the invention, it is provided that the gear rims are configured to be coaxially conical.

At least one of the shafts of the device according to the invention can optionally but not necessarily be configured as a hollow shaft, through which another substance can be introduced into the processing unit.

Preferably, an inducer having a transport vane is provided in the transport path of the substances to be homogenized in the processing unit, which inducer is disposed upstream from the gear rims. In this connection, the inducer acts as a device for transporting the substances to be homogenized in the direction towards the gear rims, under a pressure that can be regulated. For the case that the second gear rim is displaced in the direction of its central axis, in such a manner that it has been switched from a first position, in which it is disposed radially behind the first gear rim, into a second position in which it is disposed outside of the transport path of the substance capable of flow that is being transported by the first gear rim, the inducer acts as a pump device for effective transport of the substances to be homogenized.

In the transport path of the substances to be homogenized, the mixing/transporting vane is provided in the processing unit; it is also disposed upstream from the gear rims. In this connection, the mixing/transporting vane fulfills the task of mixing powder or liquids into the substance to be homogenized, in a premixed form, and of preventing material that has been mixed in from being drawn into the container, due to a partial vacuum that might be prevailing in the container. This has the advantage that the added substances can be fed in in precisely metered manner, whereby formation of agglomerates is also prevented by way of thorough mixing. The mixing/transporting vane is essentially configured like a conventional propeller having blade elements that are set at a slight slant, whereby one blade element is disposed inclined at an angle of about 5° to 10° with reference to a plane of rotation. Preferably, two to five blade elements are provided. In this connection, one blade element preferably covers an angle range of about 30° to 70°, particularly 50°. According to a preferred embodiment having four blade elements, two blade elements, in each instance, are disposed in planes of rotation that differ from one another, in this connection.

The device according to the invention will be explained in the following, using a preferred embodiment that is shown in the figures of the drawing. There, the figures show:

FIG. 1 a preferred embodiment of the device according to the invention in a cross-sectional view.

Figure 2:
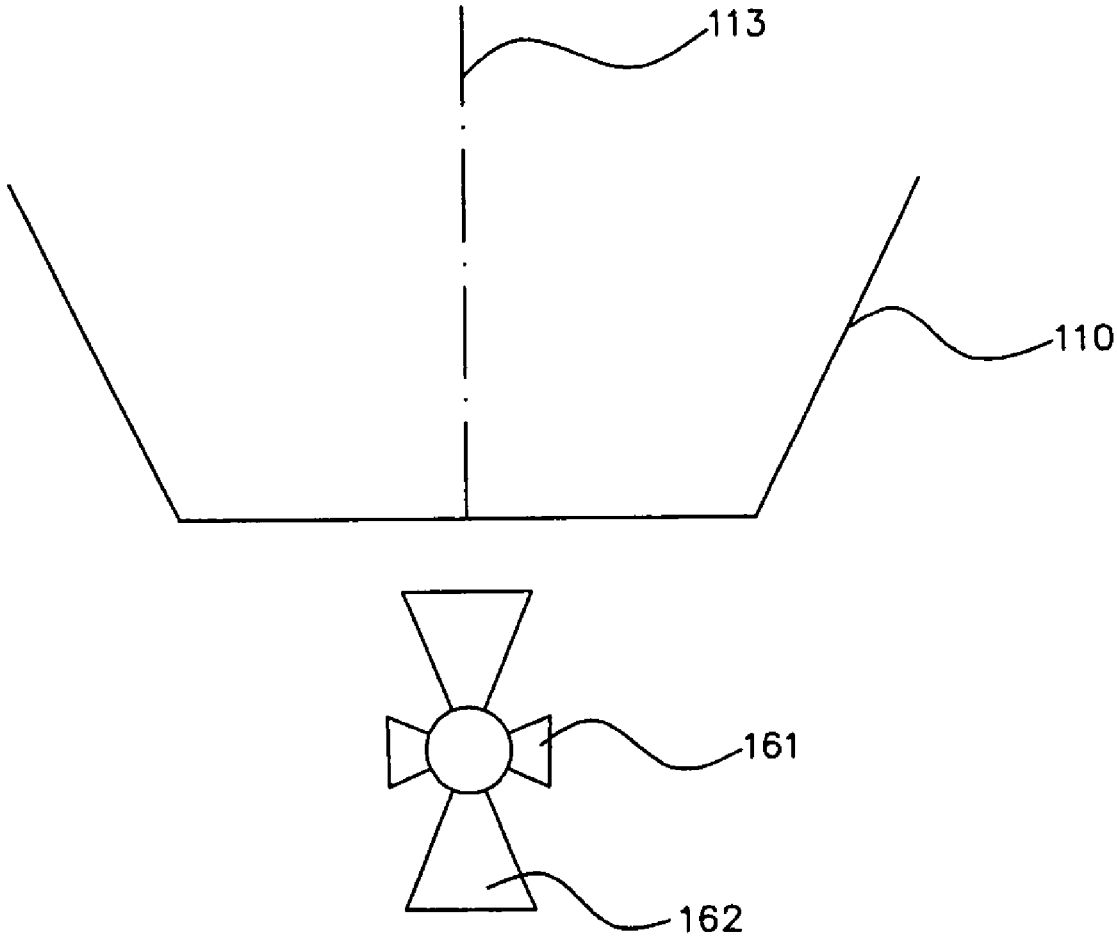

FIG. 2 the mixing/transporting vane of the device according to the invention in a side view, seen from the plane of the central axis of the container in the direction towards the inducer.

Figure 3:
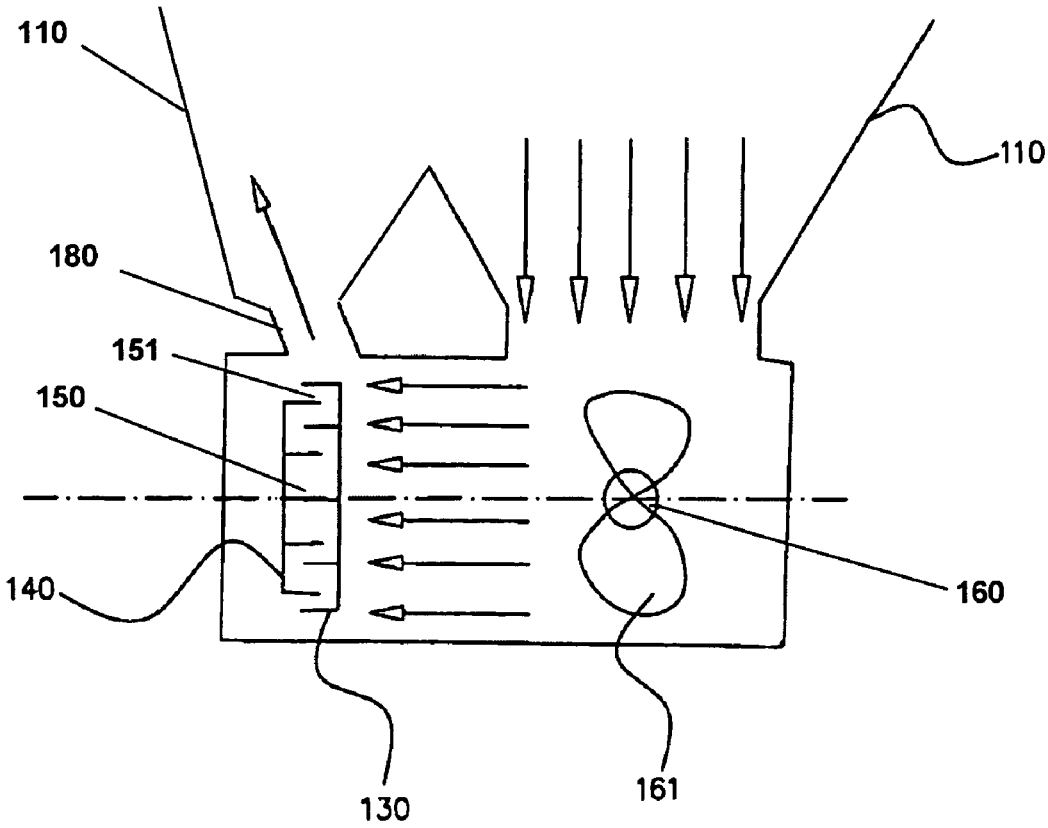

FIG. 3 a schematic cross-sectional view of a substance batch mixed by the mixing vane of the device according to the invention, in which the shaft of the mixing/transporting vane is oriented perpendicular to the central axis of the container.

Figure 4:
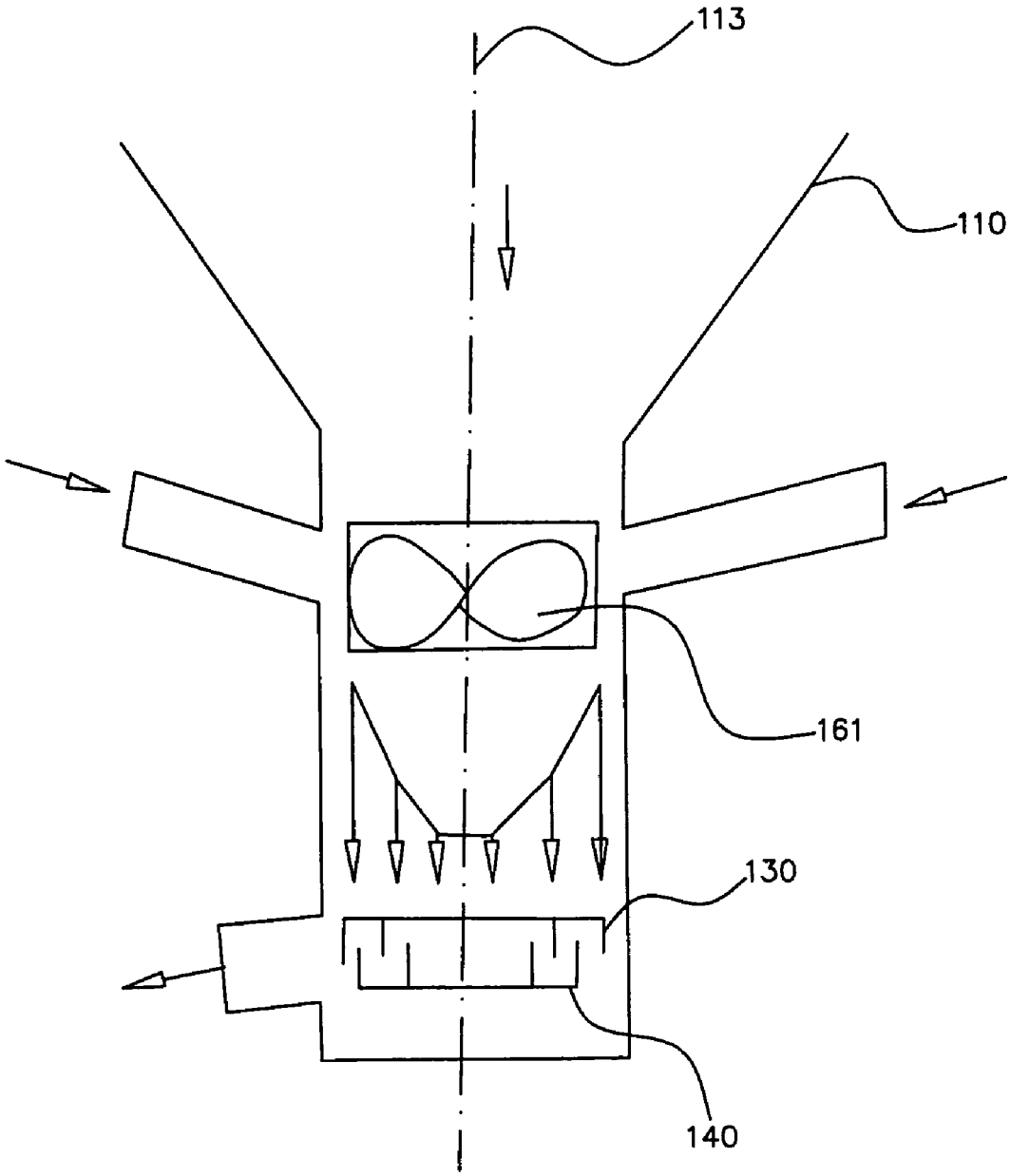

FIG. 4 a schematic cross-sectional view of a morphology and velocity profile of a substance batch mixed by a mixing/transporting vane of a device according to the state of the art, in which the shaft of the mixing/transporting vane is oriented coaxial with the central axis of the container.

Figure 5:
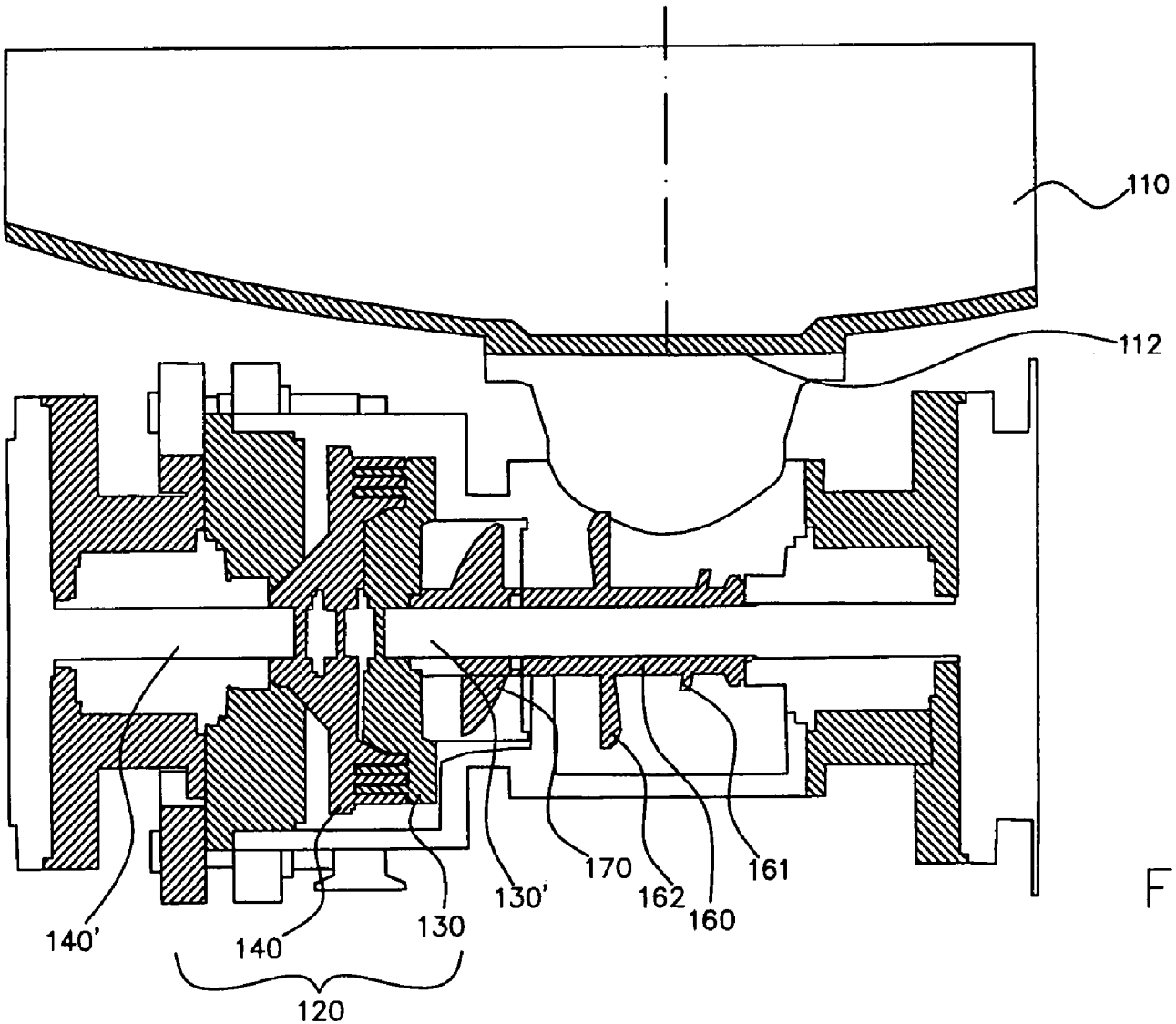

FIG. 5 a partial view of the preferred embodiment of the invention shown in FIG. 1, in a cross-sectional view, whereby the second gear rim of the rotor II radially overlaps the first gear rim of the rotor I.

Figure 6:
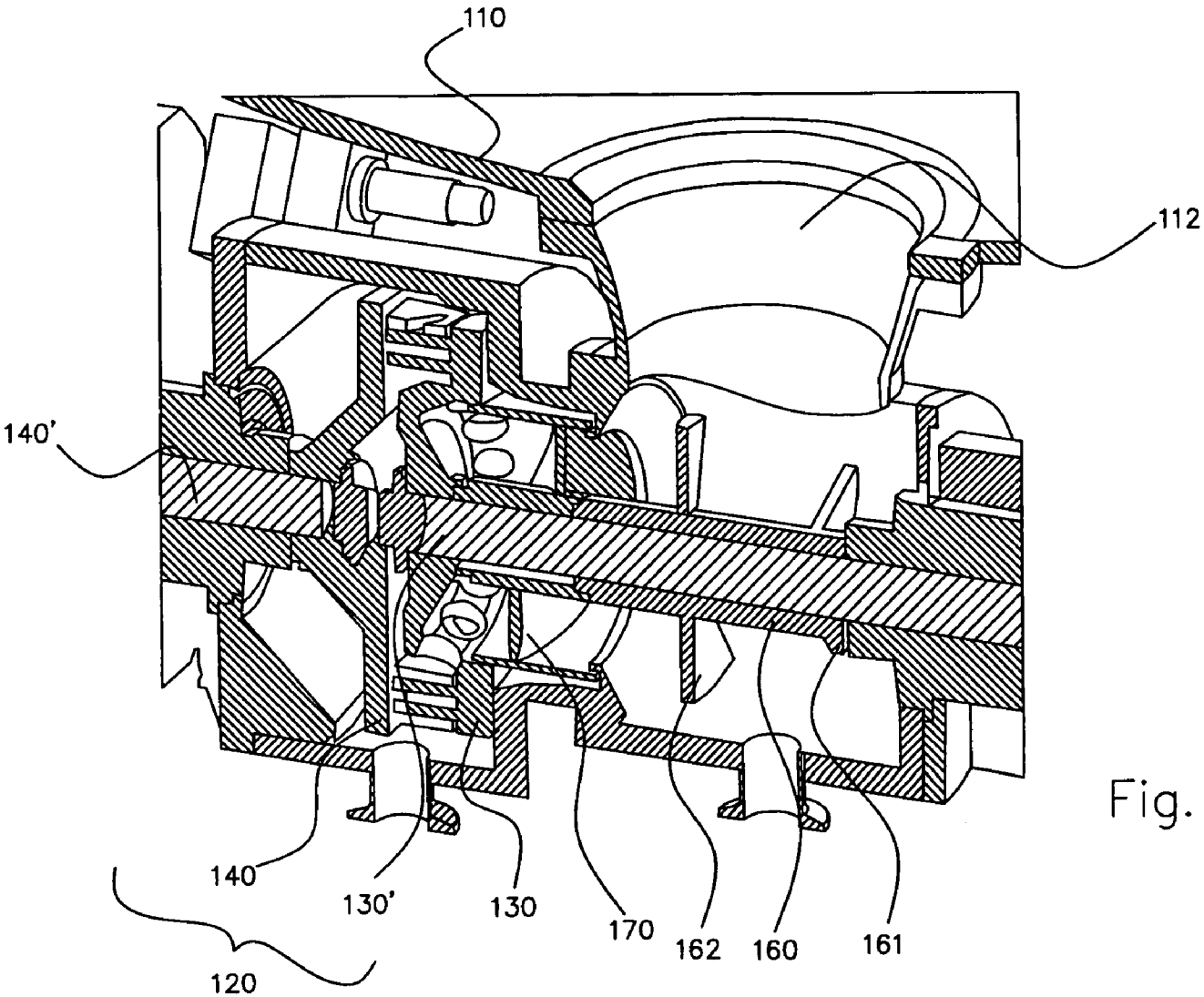

FIG. 6 a partial view of the preferred embodiment of the invention shown in FIG. 1, in a different cross-sectional view, whereby the second gear rim of the rotor II radially overlaps the first gear rim of the rotor I.

Figure 7:
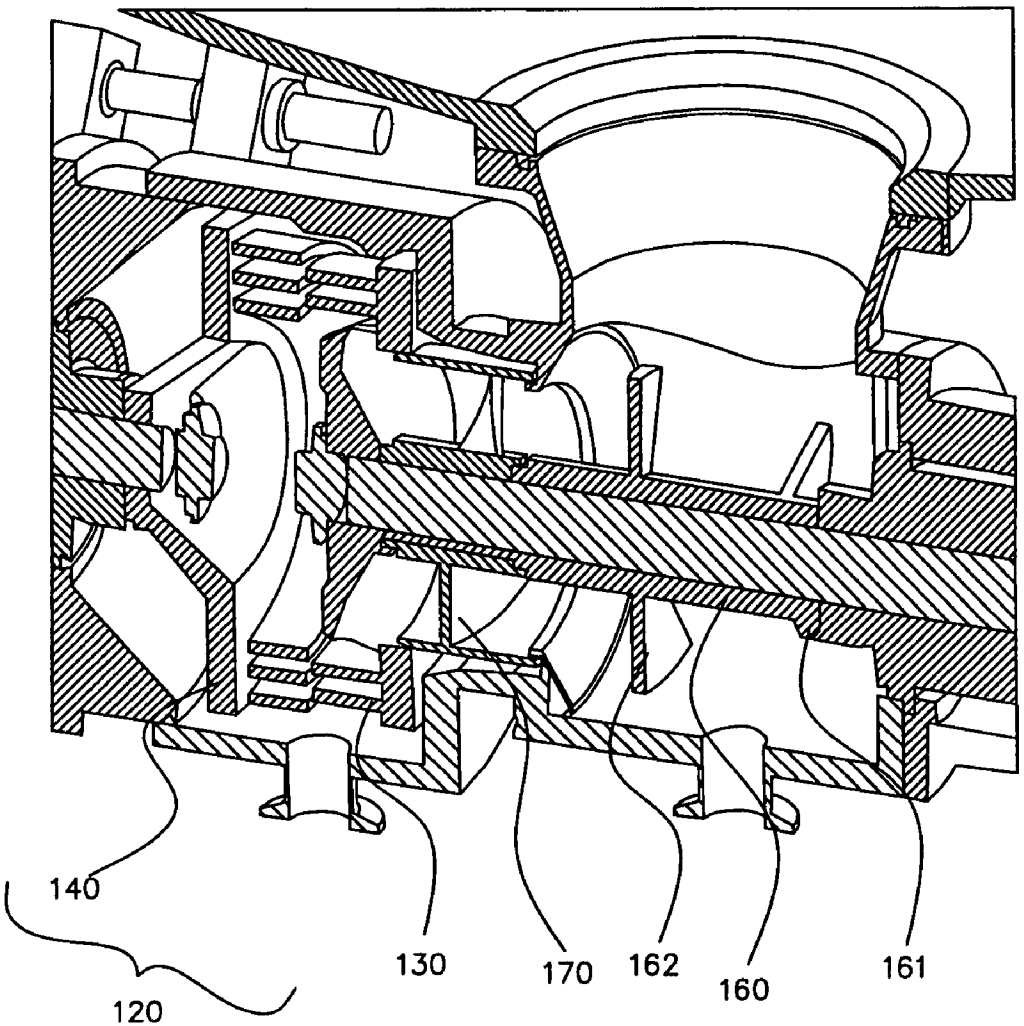

FIG. 7 a partial view of the preferred embodiment of the invention shown in FIG. 1, in a cross-sectional view, whereby the second gear rim of the rotor II is disposed outside of the transport path of the substance capable of flow that is transported by the first gear rim of the rotor I.

Figure 8:
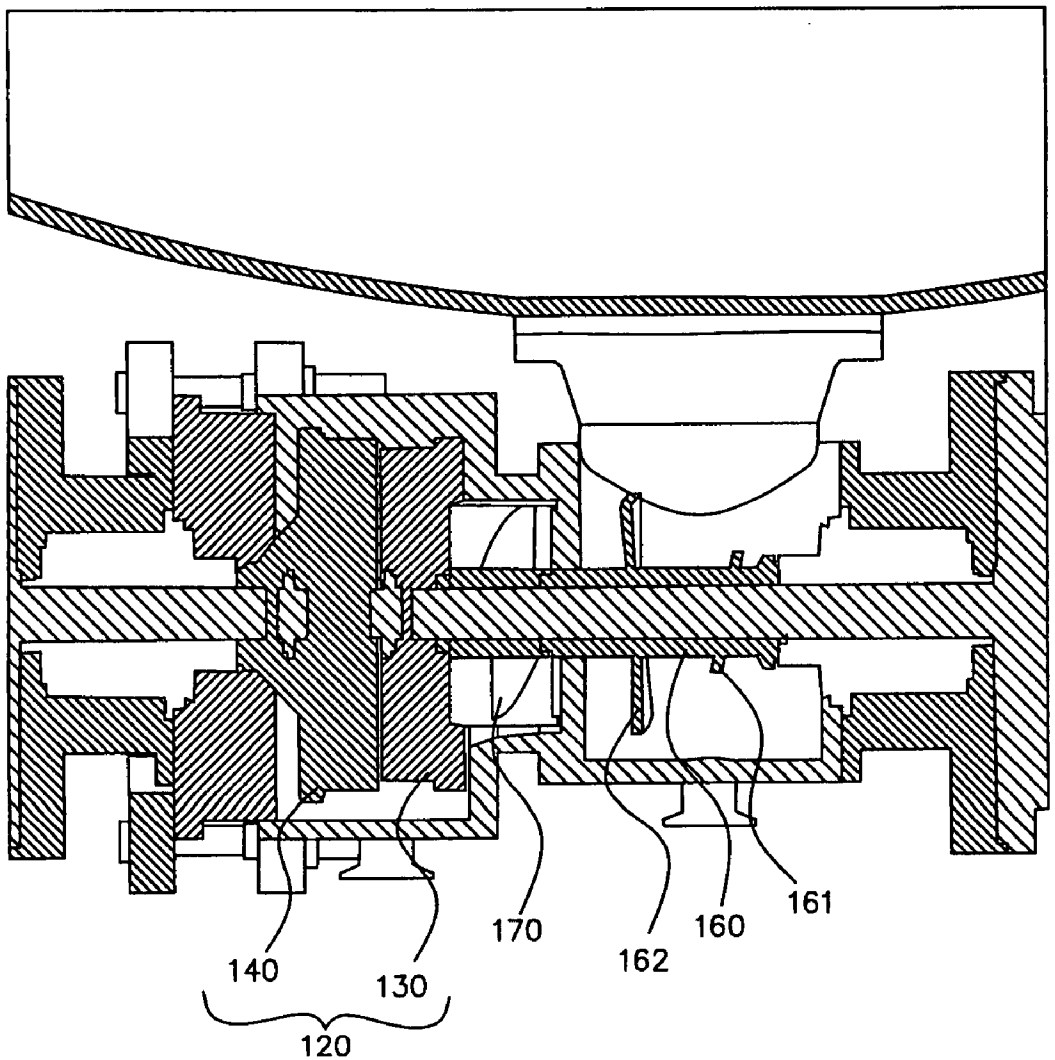

FIG. 8 a partial view of the preferred embodiment of the invention shown in FIG. 1, in a different cross-sectional view, whereby the second gear rim of the rotor II is disposed outside of the transport path of the substance capable of flow that is transported by the first gear rim of the rotor I.

The homogenizer device 100 for dispersing and/or homogenizing substances capable of flow, shown in FIGS. 1 to 8, contains a container (110) having an inner part (111), and having an inlet opening for introducing the substances to be homogenized, whereby a container outlet opening (112) for feeding the substances into a processing unit (120) disposed below the bottom is provided in a central region (114) of the bottom of the container (110).

The processing unit (120) contains two gear rims (130, 140), which are mounted to rotate independent of one another, are disposed concentrically and configured in circular shape, and are separated from one another by way of a predetermined interstice, whereby a first gear rim (130) and a second gear rim (140) are disposed in the processing unit (120) on a shaft (130', 140'), in each instance, which shafts (130', 140') are disposed perpendicular to a central axis (113) of the container (110) for the substances to be homogenized. The gear rims (130, 140) are configured as a part of the processing unit (120), which has a compact construction, and is disposed directly below the bottom of the container (110).

A mixing/transporting vane (160) having a plurality of blade elements (161, 162, 170), for mixing the substances to be homogenized with at least one powdered substance and for deflecting the transport path of the substance mixture by 90° in the direction towards the processing unit (120), which is disposed de-centered relative to the perpendicular container axis (113), is provided below the outlet opening (112), whereby the axis of rotation of the mixing/transporting vane (160) is also disposed perpendicular to the transport direction of the substances leaving the outlet opening (112).

The second gear rim (140) is mounted to be displaceable in the direction of its central axis, in such a manner that it can be switched from a first position, in which it is disposed radially behind the first gear rim (130), into a second position, in which it is disposed outside of the transport path of the substance capable of flow that is being transported by the first gear rim (130). In this connection, the gear rims (130, 140) are driven by a shaft (130', 140') disposed perpendicular to the central axis (113) of the container (110) and horizontally, in each instance. In this connection, the substance or the substances are passed from a central region (150) into a peripheral region (151) of the gear rims (130, 140) through the interstice.

After processing by the gear rims (130, 140), the substance can be returned into the container (110) into a container inlet opening (180) in the region of the container bottom (114), which is provided in a central region of the container bottom (114).

The shafts (130', 140') of the gear rims (130, 140) can be driven by separate drive units (190, 190'), and in this connection, can particularly be driven in the same direction or in opposite directions. The distance between the gear rims (130, 140), which are configured to be coaxially conical, can be adjusted by way of at least one shaft (130') mounted in displaceable manner.

An inducer is is provided in the transport path of the substances to be homogenized in the processing unit, which inducer is disposed upstream from the gear rims (130, 140). In addition to the inducer, a mixing/transporting vane (160) is provided in the transport path of the substances to be homogenized in the processing unit, which vane (160) is disposed upstream from the gear rims (130, 140).

In this connection, a mixing/transporting vane (160) is essentially configured as a conventional propeller having blade elements (161, 162, 170) set at a slight angle, whereby one blade element is disposed inclined at an angle of about 7° with reference to a plane of rotation. In this connection, one blade element preferably covers an angle range of about 45°. In this connection, two blade elements, in each instance, are disposed in planes of rotation that differ from one another.

The exemplary embodiment of the invention explained above merely serves the purpose of better understanding of the teaching according to the invention defined by the claims, which teaching is not restricted, as such, by the exemplary embodiment.

The invention claimed is:

1. A homogenizer device for dispersing and/or homogenizing substances capable of flow, having a container having one or more inlet openings for introducing the substances to be homogenized, which container has a container outlet opening for feeding the substances into a processing unit disposed below the bottom, in a central region of its bottom, which unit contains first and second gear rims, which are mounted to rotate independent of one another, are disposed concentrically and configured in circular shape, and are separated from one another by way of a predetermined interstice, wherein first and second drive shafts of the first gear rim and of the second gear rim, respectively, of the processing unit are disposed perpendicular to the transport direction of the substances that leave the outlet opening, in each instance, wherein the second gear rim is mounted to be displaceable in the direction of the central axis of the second drive shaft, in such a manner that the second gear rim can be switched from a first position, in which the second gear rim is disposed radially overlapping and axially behind the first gear rim, into a second position, in which the second gear rim is disposed outside of the transport path of the substance capable of flow that is being transported by the first gear rim, and wherein the processing unit has a compact structure, which is disposed directly below the bottom of the container.

2. The homogenizer device according to claim 1, wherein a mixing/transporting vane having a plurality of blade elements, for mixing the substances to be homogenized with at least one powdered substance, and for deflecting the transport path of the substance mixture by 90° in the direction towards the processing unit, which is disposed de-centered relative to the perpendicular container axis, is provided below the outlet opening, whereby the axis of rotation of the mixing/transporting vane is also disposed perpendicular to the transport direction of the substances leaving the outlet opening.

3. The homogenizer device according to claim 1, wherein the first and second drive shafts are horizontally disposed, in each instance.

4. The homogenizer device according to claim 1, wherein the substances, after processing by the first and second gear rims, can be returned into the container into a container inlet opening in the region of the container bottom.

5. The homogenizer device according to claim 1, wherein the substances, after processing by the first and second gear rims, can be returned into the container into a container inlet opening in the region of the container wall.

6. The homogenizer device according to claim 1, wherein the substances are passed from a central region into a peripheral region of the first and second gear rims, through the interstice.

7. The homogenizer device according to claim 1, wherein the first and second shafts can be driven by separate drive units.

8. The homogenizer device according to claim 7, wherein the first and second shafts can be operated to run in the same direction or in opposite directions.

9. The homogenizer device according to claim 1, wherein the first and second gear rims are configured to be coaxially conical.

10. The homogenizer device according to claim 1, wherein at least one of the first and second shafts is configured as a hollow shaft, through which another substance can be introduced into the processing unit (120).

11. The homogenizer device according to claim 1, wherein an inducer having a transport vane is provided in the transport path of the substances to be homogenized in the processing unit, which inducer is disposed upstream from the first and second gear rims and acts as a device for transporting the liquid in the direction towards the first and second gear rims, under a pressure that can be regulated.

12. The homogenizer device according to claim 2, wherein the mixing/transporting vane is essentially configured as a conventional propeller, whereby one blade element of the plurality of blade elements is disposed inclined at an angle of about 5° to 10° with reference to a plane of rotation of the plurality of blade elements.

13. The homogenizer device according to claim 12, wherein one blade element of the plurality of blade elements covers an angle range of about 30° to 70°.

14. The homogenizer device according to claim 13, wherein one blade element of the plurality of blade elements covers an angle range of about 50°.

15. The homogenizer device according to claim 12, wherein the plurality of blade elements consists of two to five blade elements.

16. The homogenizer device according to claim 15, wherein the plurality of blade elements consists of four blade elements.

17. The homogenizer device according to claim 16, wherein two blade elements of the mixing/transporting vane, in each instance, are disposed in planes of rotation that differ from one another.

* * * * *